US011673032B2

(12) United States Patent
Galacz et al.

(10) Patent No.: US 11,673,032 B2
(45) Date of Patent: Jun. 13, 2023

(54) MULTI-FUNCTIONAL GOLF DIVOT REPAIR TOOL

(71) Applicant: GolfGaddie LLC, Sylvan Lake, MI (US)

(72) Inventors: Robert E. Galacz, Sylvan Lake, MI (US); Colleen M. Galacz, Sylvan Lake, MI (US)

(73) Assignee: GolfGaddie LLC, Sylvan Lake, MI (US)

( * ) Notice: Subject to any disclaimer, the term of this patent is extended or adjusted under 35 U.S.C. 154(b) by 0 days.

(21) Appl. No.: 17/579,881

(22) Filed: Jan. 20, 2022

(65) Prior Publication Data

US 2022/0233927 A1 Jul. 28, 2022

Related U.S. Application Data

(60) Provisional application No. 63/142,303, filed on Jan. 27, 2021.

(51) Int. Cl.

| | |
|---|---|
| ***A63B 57/50*** | (2015.01) |
| ***A63B 57/20*** | (2015.01) |
| *A63B 57/60* | (2015.01) |
| *A63B 55/10* | (2006.01) |

(52) U.S. Cl.
CPC ..... *A63B 57/50* (2015.10); *A63B 57/203* (2015.10); *A63B 57/207* (2015.10); *A63B 55/10* (2013.01); *A63B 57/60* (2015.10)

(58) Field of Classification Search
CPC ..... A63B 57/50; A63B 57/203; A63B 57/207
See application file for complete search history.

(56) References Cited

U.S. PATENT DOCUMENTS

| | | | | | |
|---|---|---|---|---|---|
| 3,298,579 | A * | 1/1967 | Smith | A45F 5/021 | 224/183 |
| 4,151,937 | A * | 5/1979 | Jarosh | A63B 57/20 | 273/DIG. 26 |
| 4,960,239 | A * | 10/1990 | Wait | A63B 57/50 | 473/406 |
| 5,226,647 | A * | 7/1993 | Notarmuzi | A63B 57/50 | 473/285 |
| 5,305,999 | A * | 4/1994 | Tate | A63B 57/353 | 224/269 |
| 5,782,708 | A * | 7/1998 | Kimball, Jr. | A63B 57/50 | 473/408 |
| 6,095,934 | A * | 8/2000 | Ohama | A63B 57/207 | 473/406 |
| 6,220,973 | B1 * | 4/2001 | Hsu | A63B 57/203 | 473/406 |
| 6,290,617 | B1 * | 9/2001 | Cole | A63B 57/207 | 473/286 |
| D505,473 | S * | 5/2005 | Foley | D21/793 | |

(Continued)

FOREIGN PATENT DOCUMENTS

| | | | | |
|---|---|---|---|---|
| DE | 29913328 U1 * | 9/1999 | A63B 57/00 | |
| DE | 20218819 U1 * | 2/2003 | A63B 55/10 | |

(Continued)

*Primary Examiner* — Steven B Wong
(74) *Attorney, Agent, or Firm* — Harness, Dickey & Pierce, P.L.C.

(57) ABSTRACT

A golf divot repair tool includes an elongated body having a front side, a back side, a right side, a left side, a bottom side and a top side. The elongated body has a longitudinal axis. A first tee receiver is disposed along the right side. A second tee receiver is disposed along the left side. A ball marker receiver is disposed in the body. A tool extension extends from a bottom side of the body.

18 Claims, 13 Drawing Sheets

(56) References Cited

U.S. PATENT DOCUMENTS

| | | | | |
|---|---|---|---|---|
| 7,238,126 | B1 * | 7/2007 | Wiens | A63B 57/50 473/408 |
| 7,654,920 | B2 | 2/2010 | Perry | |
| 8,454,457 | B1 * | 6/2013 | Woods | A63B 57/353 15/106 |
| 8,512,163 | B2 | 8/2013 | McDowell et al. | |
| D700,262 | S | 2/2014 | Zwart | |
| D708,286 | S * | 7/2014 | Hinshaw | D21/793 |
| 9,114,289 | B1 * | 8/2015 | Bradshaw | A63B 57/50 |
| D775,701 | S * | 1/2017 | Hinshaw | D21/793 |
| 9,669,276 | B1 * | 6/2017 | Maloy | A63B 57/353 |
| 2002/0162866 | A1 * | 11/2002 | Hurtgam | A45F 5/00 224/684 |
| 2003/0010796 | A1 * | 1/2003 | Hurtgam | A63B 57/207 224/269 |
| 2004/0248674 | A1 * | 12/2004 | Bauley | A63B 57/353 473/406 |
| 2007/0111826 | A1 * | 5/2007 | Blanks | A63B 57/50 473/408 |
| 2007/0149325 | A1 * | 6/2007 | Vargas | A63B 57/353 473/286 |
| 2009/0209369 | A1 * | 8/2009 | Smith | A63B 57/50 224/183 |
| 2011/0039639 | A1 | 2/2011 | Carsey | |
| 2011/0207559 | A1 | 8/2011 | Petela | |
| 2021/0121750 | A1 * | 4/2021 | Krauter | A63B 57/20 |

FOREIGN PATENT DOCUMENTS

| | | | | |
|---|---|---|---|---|
| WO | WO-2005115564 | A1 * | 12/2005 | A63B 55/20 |
| WO | WO-2007032578 | A1 * | 3/2007 | A63B 57/0031 |

* cited by examiner

MULTI-FUNCTIONAL GOLF DIVOT REPAIR TOOL

CROSS-REFERENCE TO RELATED APPLICATION

The present disclosure claims priority to provisional application 62/142,303 filed on Jan. 27, 2021. The disclosure of which is incorporated by reference herein.

FIELD

The present disclosure relates generally to a golf divot repair tool and, more particularly, to a multi-functional divot repair tool.

BACKGROUND

This section provides background information related to the present disclosure which is not necessarily prior art.

While playing the game of golf, there are many items used for playing the game beyond a ball and clubs. These items include the use of tees for positioning a ball above the ground before striking it, a ball marker for marking the position of a ball while on the green and a divot repair tool for repairing any divots caused from hitting the ball onto the green.

While playing the game, the club faces often accumulate dirt within the grooves. Many golfers carry a groove cleaner or brush to clean the grooves of the golf club face.

It is often inconvenient to carry all of the devices and find them easily within the pocket of the player. Often times, the tees poke the user while playing because the tees have a sharp end.

Another difficulty golfers face, especially when playing in the morning, is moisture on the grass. When playing golf, a player may hand carry more than one club while approaching the green. Laying the extra club on the grass allows the club grip to pick up the moisture from the grass. Often times, a towel is used to prevent moisture from collecting on the club grip.

SUMMARY

This section provides a general summary of the disclosure, and is not a comprehensive disclosure of its full scope or all of its features.

The present disclosure provides a multi-functional tool that incorporates a holder for a golf ball marker, a place of two tees, a divot tool for repair ball marks and a groove cleaner. The present system may have a clip that allows the tool to be clipped to a hat or a pocket.

In one aspect of the disclosure, a golf divot repair tool includes an elongated body having a front side, a back side, a right side, a left side, a bottom side and a top side. The elongated body has a longitudinal axis. A first tee receiver is disposed along the right side. A second tee receiver is disposed along the left side. A ball marker receiver is disposed in the body. A tool extension extends from a bottom side of the body.

Another feature of the disclosure is a club rest that allows the club face to be positioned above the ground. The divot tool is inserted into the ground with the fork or repair end and the club rest is positioned upward.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1A:
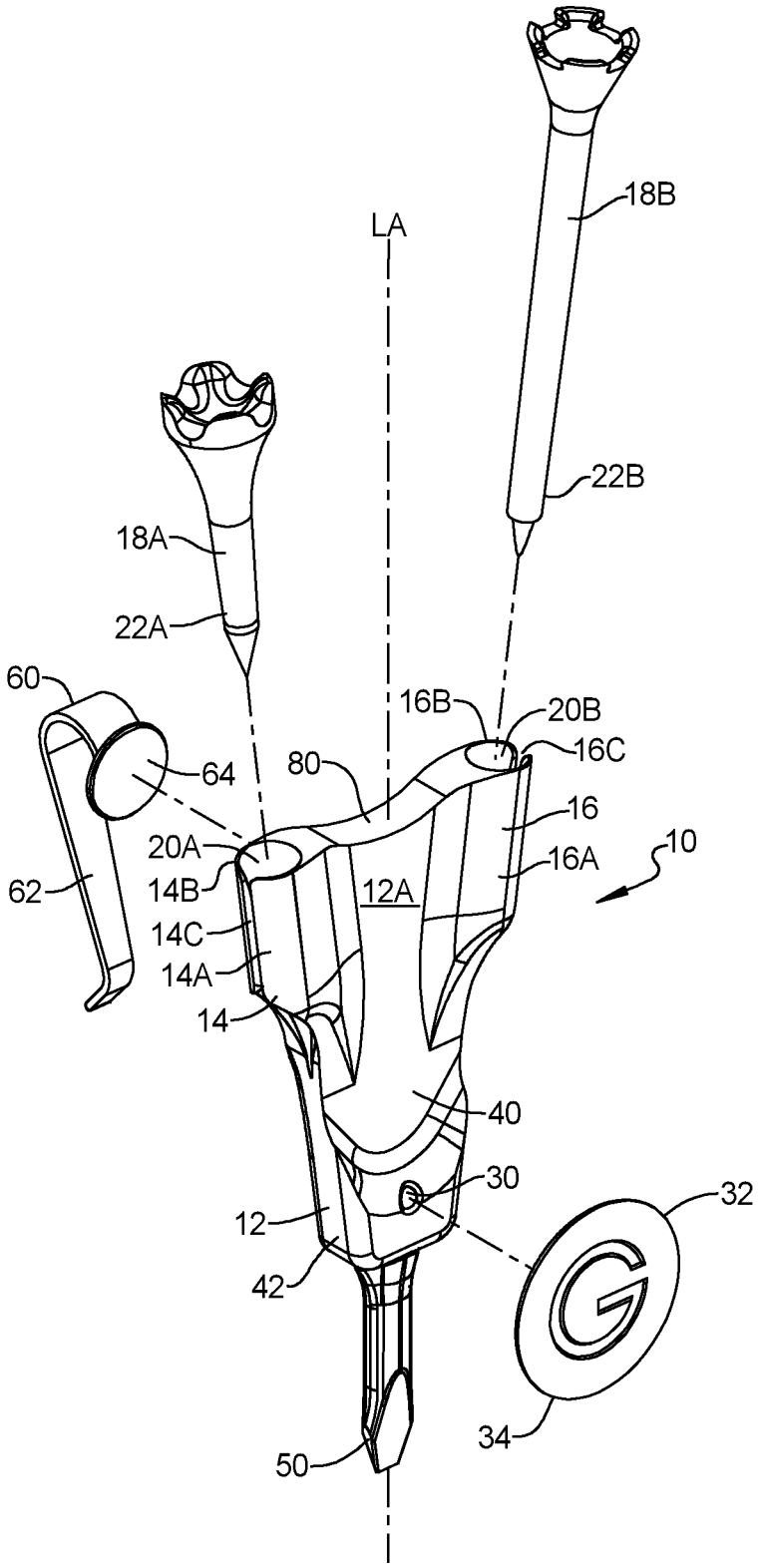
FIG. 1A is a perspective front exploded view of a first example of a divot repair too.
Figure 1B:
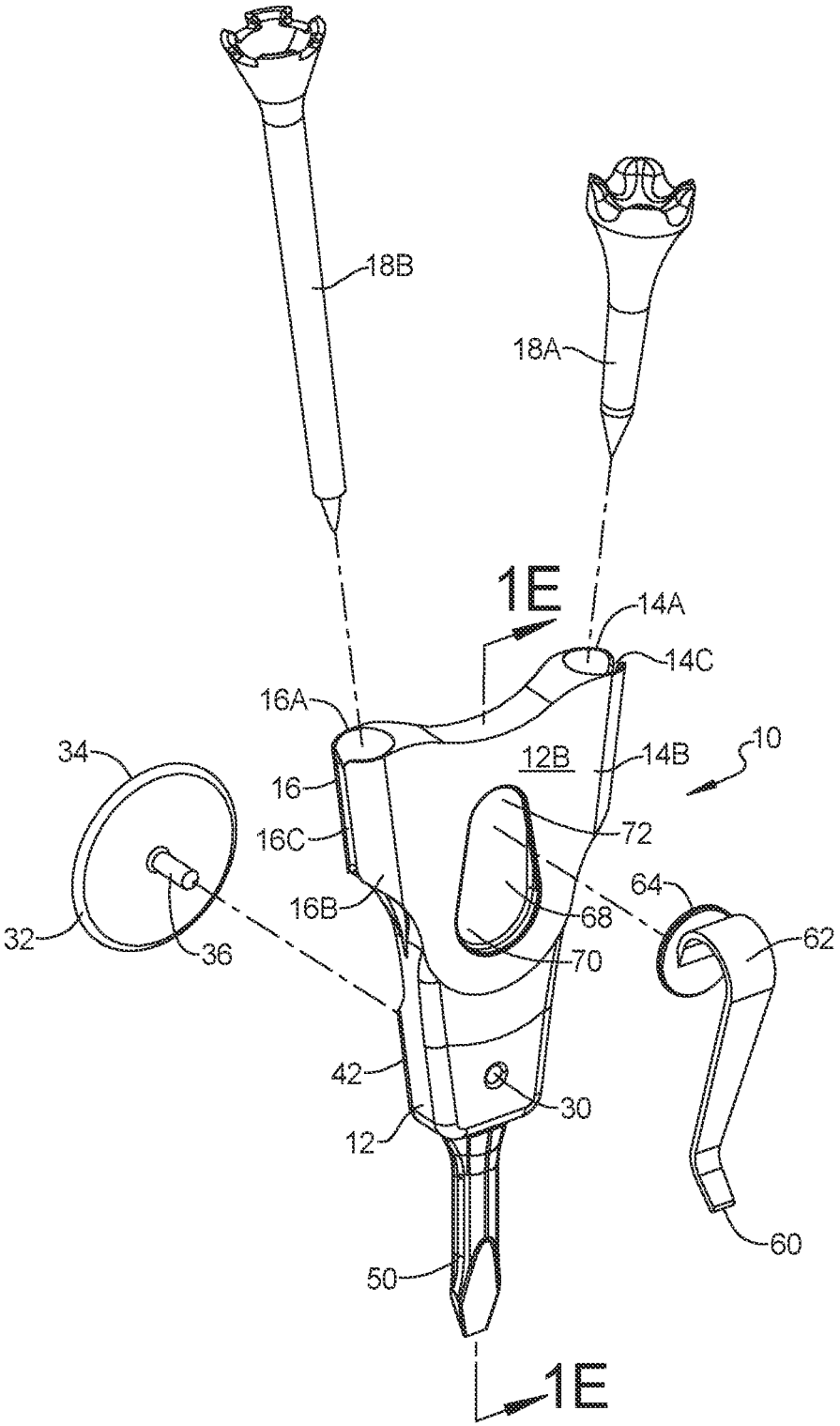
FIG. 1B is a rear exploded view of the divot repair tool of FIG. 1A.

Example embodiments will now be described more fully with reference to the accompanying drawings.

The divot repair tool is used for receiving tees, a clip and a ball marker. Also formed on the divot repair tool are either one or two prongs or repair forks. The end of the repair fork or forks are tapered to act as a groove cleaner to clean to the grooves in a club face. Tee slots are disposed on each side of the repair tool body to receive the tees. While playing golf, a golfer typically carries two tees, a large tee for hitting clubs such as a driver and small tee for hitting less clubs, such as irons, from the tee box area. The tee slots extend longitudinally on each side of the body and prevent the ends of the tees from being exposed to potentially poke the golfer. A channel or hole is formed within the body to receive the end of a ball marker so that the ball marker may be secured to the body.

The top surface of the body includes a club rest that is a curved recess within the body. As briefly mentioned above, the divot repair forks or prongs may be inserted into the ground and the club rest used to receive the grip end of a club to suspend the grip end of the club above the grassy surface. This prevents the grip from becoming moist especially in the morning hours. A recess disposed on at least face of the body is suitable for receiving the thumb of a user for assisting the user while inserting the device within the ground for use as a club rest or while fixing a divot on the green.

In some examples, a removable clip is inserted within a clip slot. The clip slot is a longitudinally disposed clip that, in this example, is U-shape. Other shapes, of course, may be used. The clip in this example is removable although an affixed clip may also be used. The clip may be used for clipping the repair tool to the brim of a hat or to a pocket of the golfer.

In use, when a tee is to be placed into the repair tool, the tee is inserted longitudinally into one of the two tee slots. Each tee slot may be merely circular in cross section. That is, a channel longitudinally disposed on the side of the tee slot allows the tee slot to conform to the diameter of the tees. Not all tees have the same diameter. The head of the tee is pulled to remove the tees from the tee slots when removal of the tee is desired for use.

The ball marker is received within the ball marker hole or channel. The head of the ball marker is pulled laterally outwardly to remove the ball marker for use. Likewise, the slip is inserted into the clip slot when the clip is to be used. The clip may be removed easily when the golfer wants to remove the clip should no clipping action be desired. The clip is removed in a longitudinal direction.

Referring now to FIGS. 1A-1E, a first example of a divot repair tool 10 is set forth. The divot repair tool 10 has a body 12 that has a longitudinal axis LA. In this example, the body 12 has a first tee receiver 14 and a second tee receiver 16 that are elongated slots. The first tee receiver 14 and the second tee receiver 16, in this example, are set forth at an angle relative to the longitudinal axis LA. That is, each tee receiver 14, 16 have a first end for receiving the tee first. The tees are inserted in the first end of the receiver 14, 16 and pushed toward a second end of the receiver 14, 16. The second end of each receiver 14, 16 is closer to the longitudinal axis LA. The first tee receiver 14 and the second tee receiver 16 are generally cylindrical in shape, each with the first open end to receive a tee. The first tee receiver 14 has a first curved wall 14A, a set curved wall 14B and a slot 14C that extends between the first wall 14A and the second wall 14B. The walls 14A-14B, 16A-16B are integrally formed with the body 12. The body 12 may be formed of a flexible material such as plastic and thus the walls 14A, 14B, 16A, and 16B flex to accommodate the diameter of tees 18A, 18B by expanding the diameter of the tee receivers 14, 16. In the present example, tee 18A is a short tee and tee 18B is a long tee. Typically, a golfer carries both a small tee 18A and a large tee 18B while playing.

The first tee receiver 14 and the second tee receiver 16 have longitudinally extending passages 20A, 20B, respectively. The diameters of the passages 20A, 20B are such that the diameters of the shafts 22A, 22B of the respective tees 18A, 18B may be received therein. The diameter of the passages may be slightly smaller or about the diameter of the shafts 22A, 22B. Because of the slots 14C, 16C, the tees 18, 18B receive pressure from the walls 14A, 14B, 16A, 16B to allow the tees 18A, 18B to be secured during play while allowing the golfer to remove the tees when needed for play.

A ball marker receiver 30 is disposed through the body 12. The ball marker receiver 30 is formed from a channel that extends from the first surface toward a rear surface of the body 12. The ball marker receiver 30 may extend completely through or partial through the body 12. In this example, the ball marker receiver 30 is perpendicular to the longitudinal axis.

The ball marker receiver 30 is used to secure a ball marker 32 to the body 12. The ball marker 32 has a marking surface 34 and a retaining post 36. The retaining post 36 is used during play to prevent movement of the marking surface 34. However, the retaining post 36 has a diameter that allows the ball marker receiver 30 to receive and secure the ball marker 32. That is, the diameter of the ball marker receiver 30 is about the same size as the ball marker receiver 30 so that during play, the ball marker 32 can be easily removed from the ball marker receiver.

As is best shown in FIG. 1A, a recess 40 is formed between the first tee receiver 14, the second tee receiver 16 and a raised portion 42 adjacent to the ball marker receiver 30 and a tool extension 50. The recess 40 may receive a thumb to assist in gripping the tool for fixing the divot or cleaning grooves in a club head.

The tool extension 50 extends from the bottom side of the body 12. The tool extension 50, in this example, has a flat surface similar to a flat head screw driver. The tool extension 50 may be used for fixing divots made by a golf ball on a green. However, the tool extension 50 may also be used for various other purposes such as a groove cleaner for various clubs or to remove debris from golf spikes. The tool extension 50 extends in a longitudinal direction that corresponds to the longitudinal axis LA. That is, the tool extension 50 extends longitudinally from the bottom of the body 12. Of course, other shapes may be used such as completely round, cylindrical and round with a pointed end.

A clip 60 has a clip arm 62 and a clip key 64. The clip key 64 has a relatively thin thickness and is received in a clip slot 68. A cross-sectional view of the clip slot 68 is illustrated in FIG. 1E. The clip slot 68 receives the clip key 64 and, in this example, is slid in a longitudinally upward direction. That is, the clip slot has a large end 70 and a small end 72. The large end 70 receives the clip key 64. The clip key 64 is then slid upward toward the small end 62 so that clip key 64 is retained within the clip slot 68. The clip 60 may be used for attaching the divot repair tool to a garment, such as a pocket, or to a portion of a hat, such, as the visor of a hat. The garment or hat to which the divot repair tool 10 is coupled fits between the arm 62 and a rear surface of the body 12.

The upper surface of the body 12 has a rest 80 disposed thereon. In this example, the rest 80 is curved inward (concave) toward the tool extension 50 and may be used for resting a cigar or golf club during play. The rest 80 is disposed between the first tee receiver 14 and the second tee receiver 16.

Figure 1C:
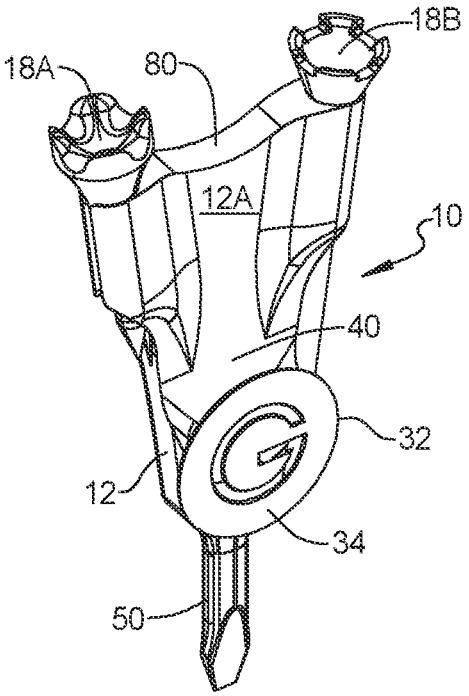
FIG. 1C is a perspective view of the divot repair tool assembled with a ball marker and two tees.
Figure 1D:
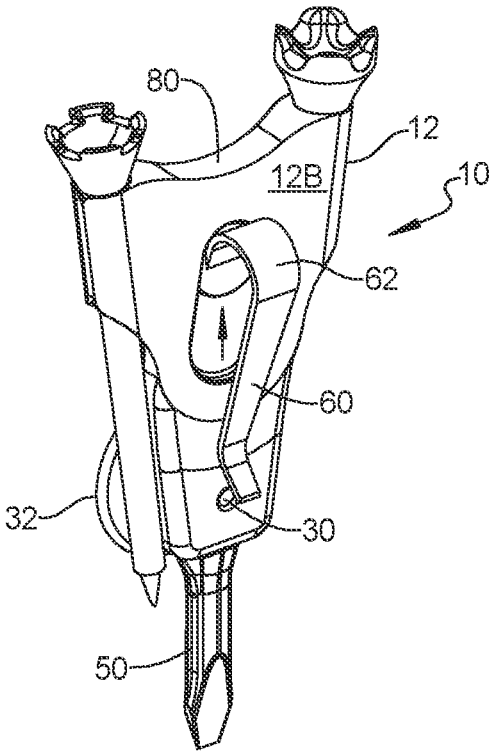
FIG. 1D is a rear perspective view of the assembled first example of the divot repair tool.
Figure 1E:
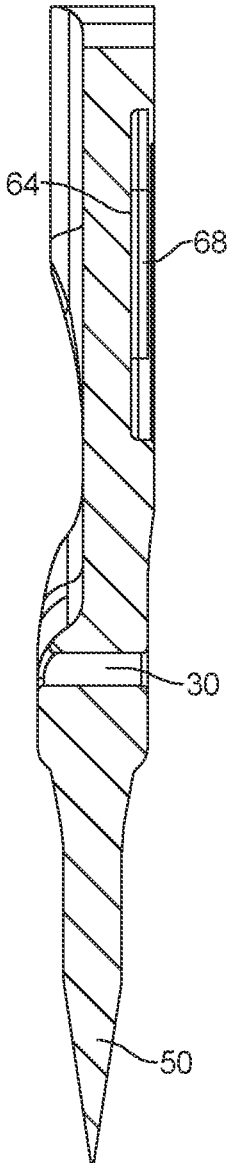
FIG. 1E is a cross-sectional view longitudinal extending through the divot repair tool of FIGS. 1A-1D.

Referring now specifically to FIGS. 1C and 1D, the divot repair tool 10 is illustrated in use. That is, the first tee receiver 14 and the second tee receiver 16 are used to receive the tees 18A, 18B. Likewise, the ball marker receiver 30 receives the retaining post of the ball marker 32 that is coupled to the front surface 12A.

Figure 2A:
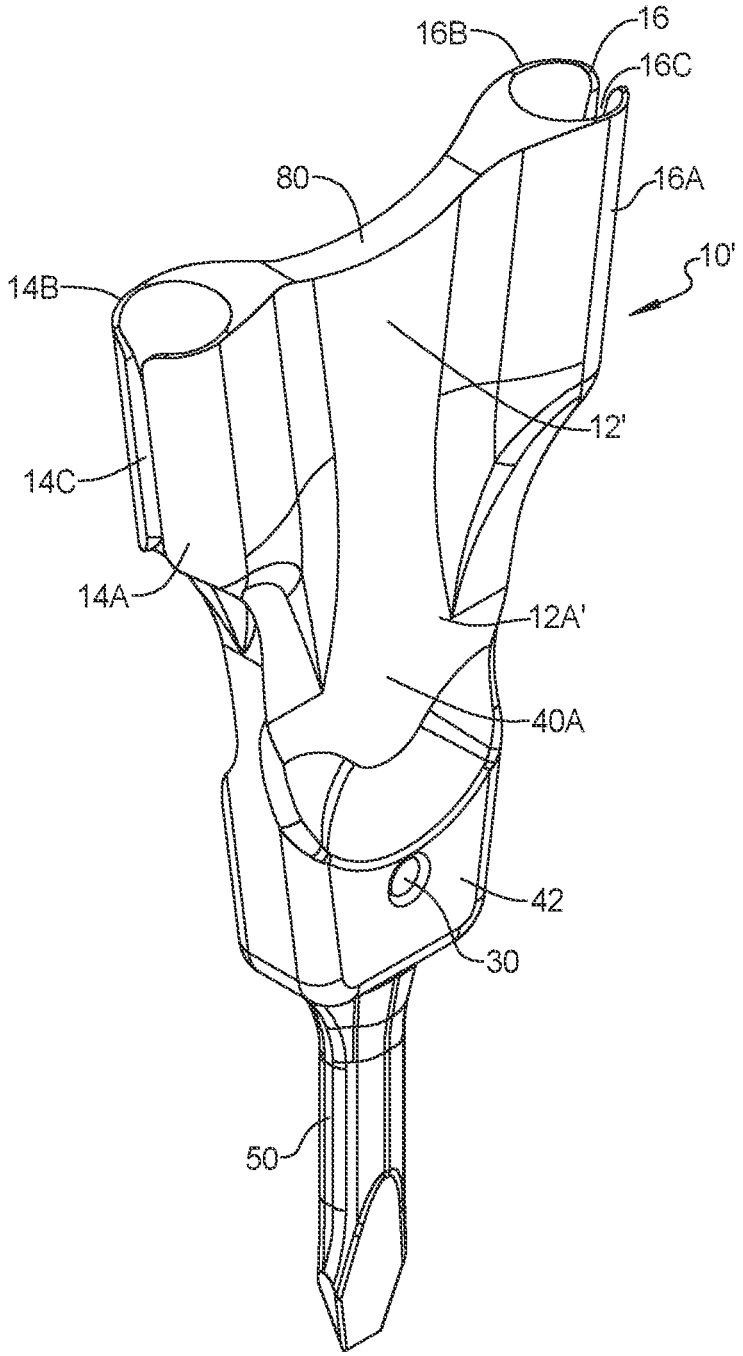
FIG. 2A is a front perspective view of a second example of a divot repair tool without a clip.
Figure 2B:
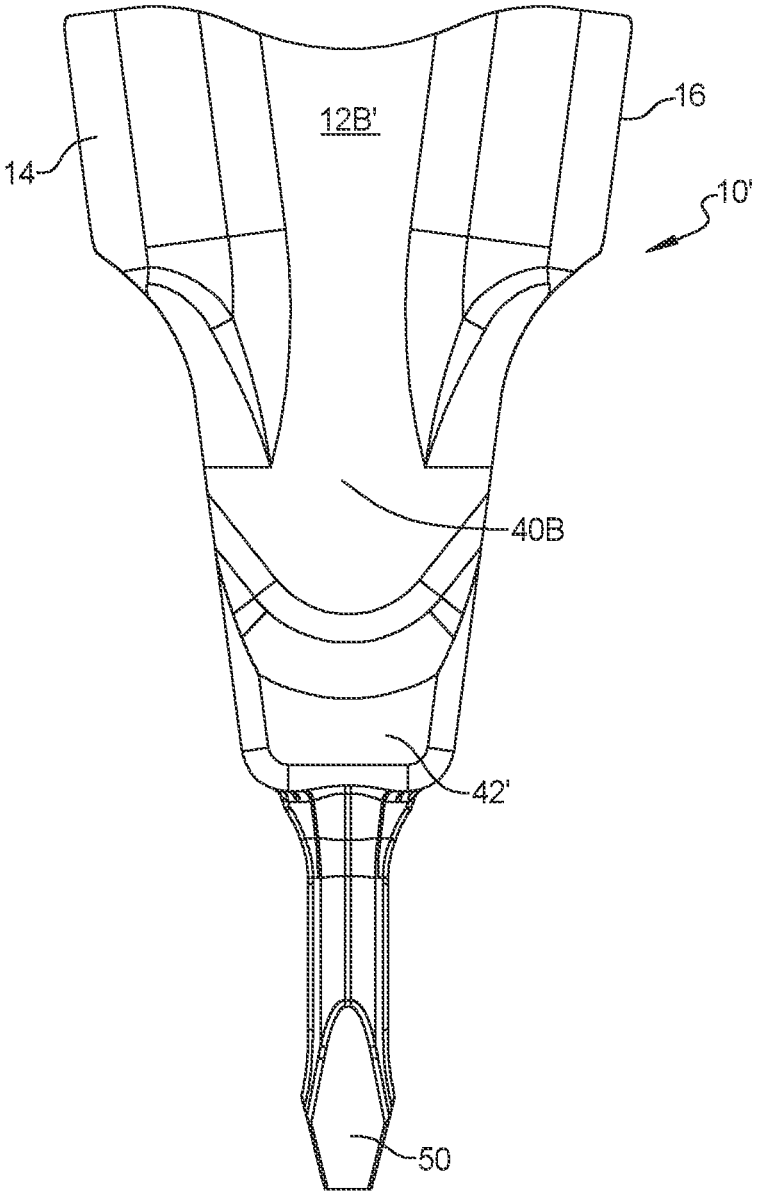
FIG. 2B is a rear view of the divot repair tool of FIG. 2A.
Figure 2C:
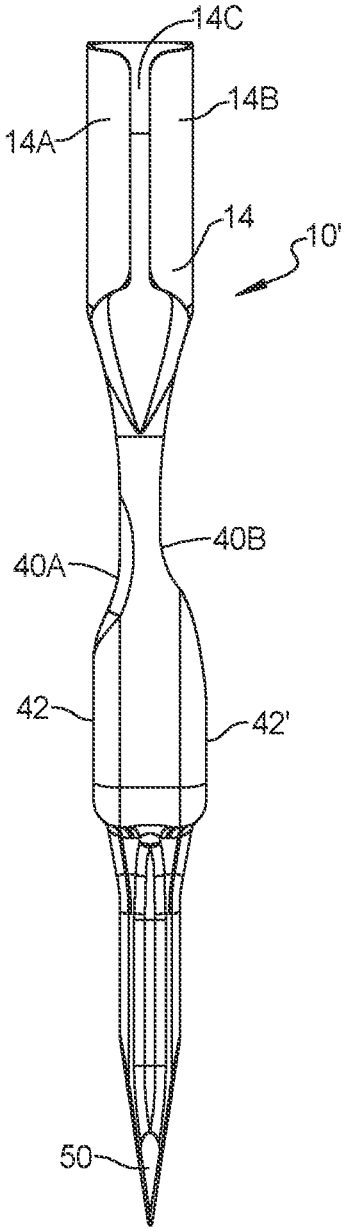
FIG. 2C is a side view of the divot repair tool of FIGS. 2A and 2B.

Referring now to FIGS. 2A-2C, a second example of a divot repair tool 10' is set forth. In this example, the divot repair tool 10' has a recess 40A on the front side 12A' of the body 12' and does not have a clip 60 attached to the back side 12B'. Instead, the back side 12B' has a recess 40B formed in a similar manner to the recess 40 described in FIG. 1. That is, the recess 40B is disposed between the first tee receiver 14, the second tee receiver 16 and the raised portion 42'.

Figure 3A:
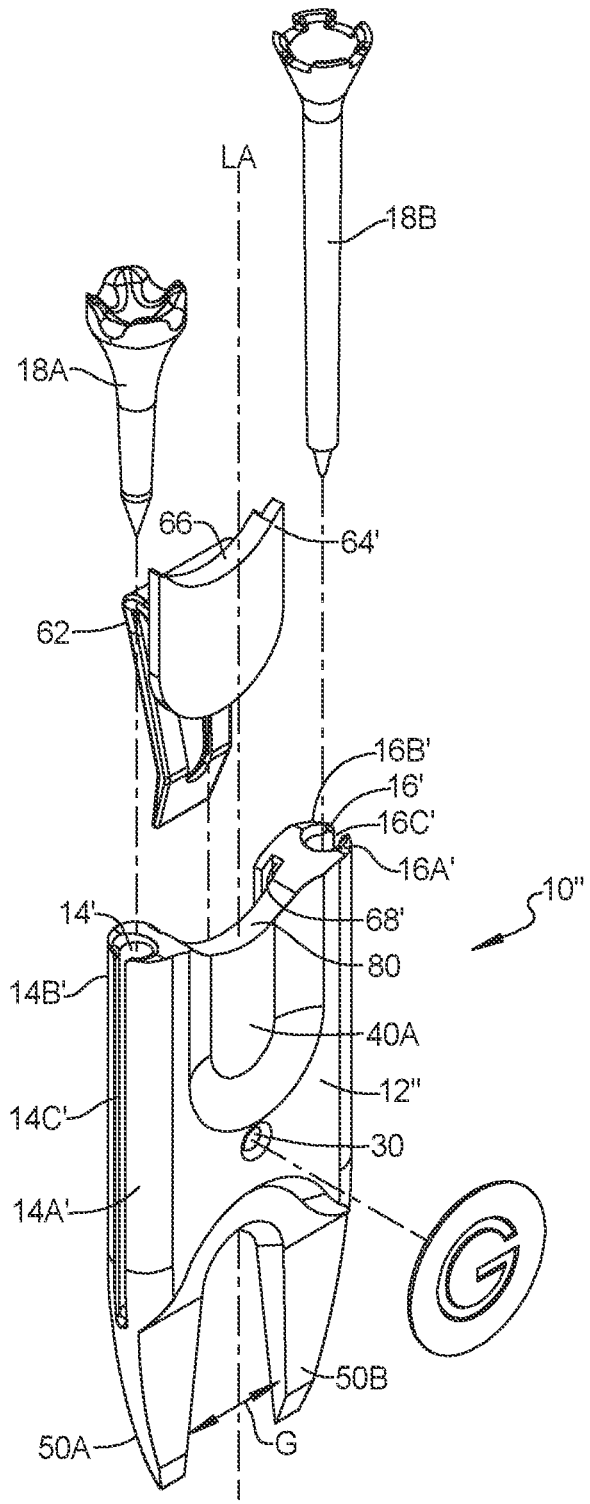
FIG. 3A is a third example of a divot repair tool having a different clip than FIGS. 1A-1E.
Figure 3B:
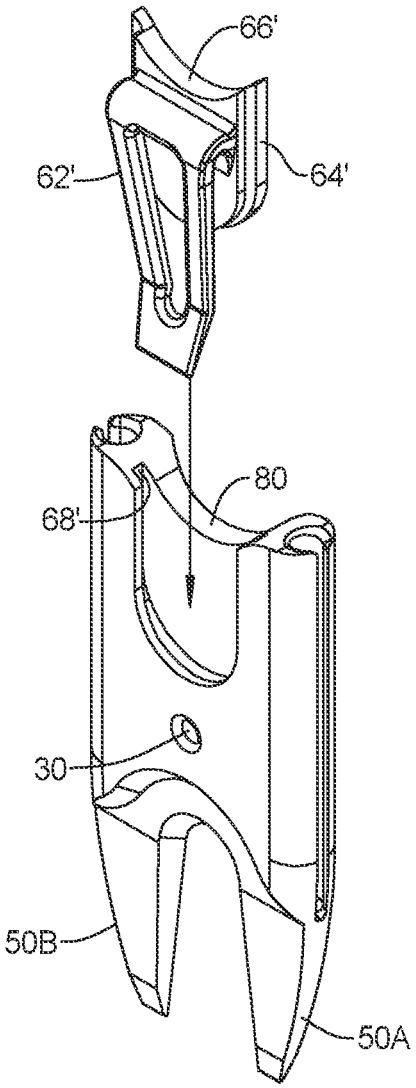
FIG. 3B is a rear perspective view of the divot repair tool of FIG. 3A.
Figure 3C:
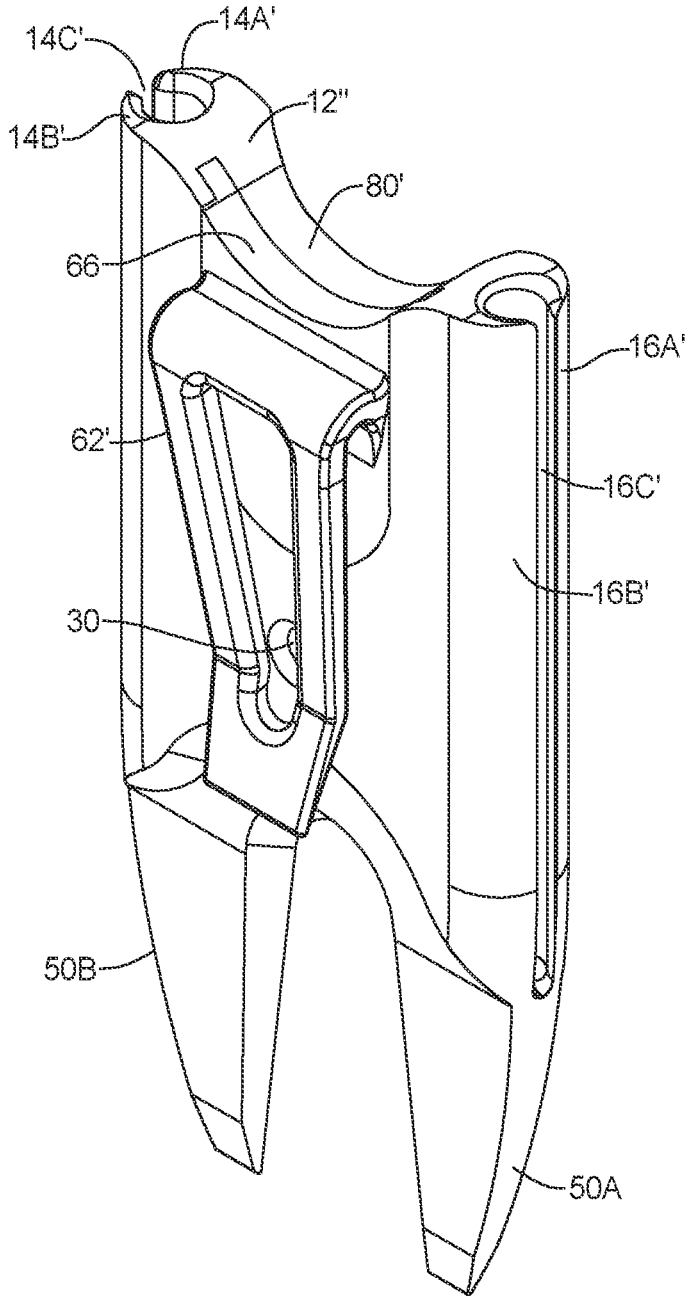
FIG. 3C is an assembled view of divot repair tool of FIGS. 3A and 3B.

Referring now to FIGS. 3A-3C, a third example of a divot repair tool 10' is set forth. In this example, two tool extensions 50A and 50B are used that are separated by a gap G. In this example, the body 12" has the first tee receiver 14' and the second tee receiver 16' parallel to the longitudinal axis LA. In this example, the end of the first tee receiver 14' and the second tee receiver 16' are enclosed to fully receive the end of the tees 18A, 18B. The right and left sides of the body 12 are parallel to the longitudinal axis LA. In this example, the clip slots 68' receives the clip key 64' in a longitudinally downward direction. That is, the opening of the clip slot 68' is adjacent to the rest 80 and is assembled by moving the clip key 64' in a downward direction toward the tool extensions 50A, 50B.

The clip key 64' has an upper surface 66 that is continuous with the rest 80 in this example. That is, the rest 80 and the upper surface 66 of the clip key 64' form a continuous surface for resting a club or cigar.

The wall portions 14A' and 14B' of the tee receiver 14 and the wall portion 16A' and 16B' are flexible even though the walls are coupled to the body 12". The slots 14C' and 16C' allow the first tee receiver and the second tee receiver to conform to the outer diameter of various size tees.

Figure 4:
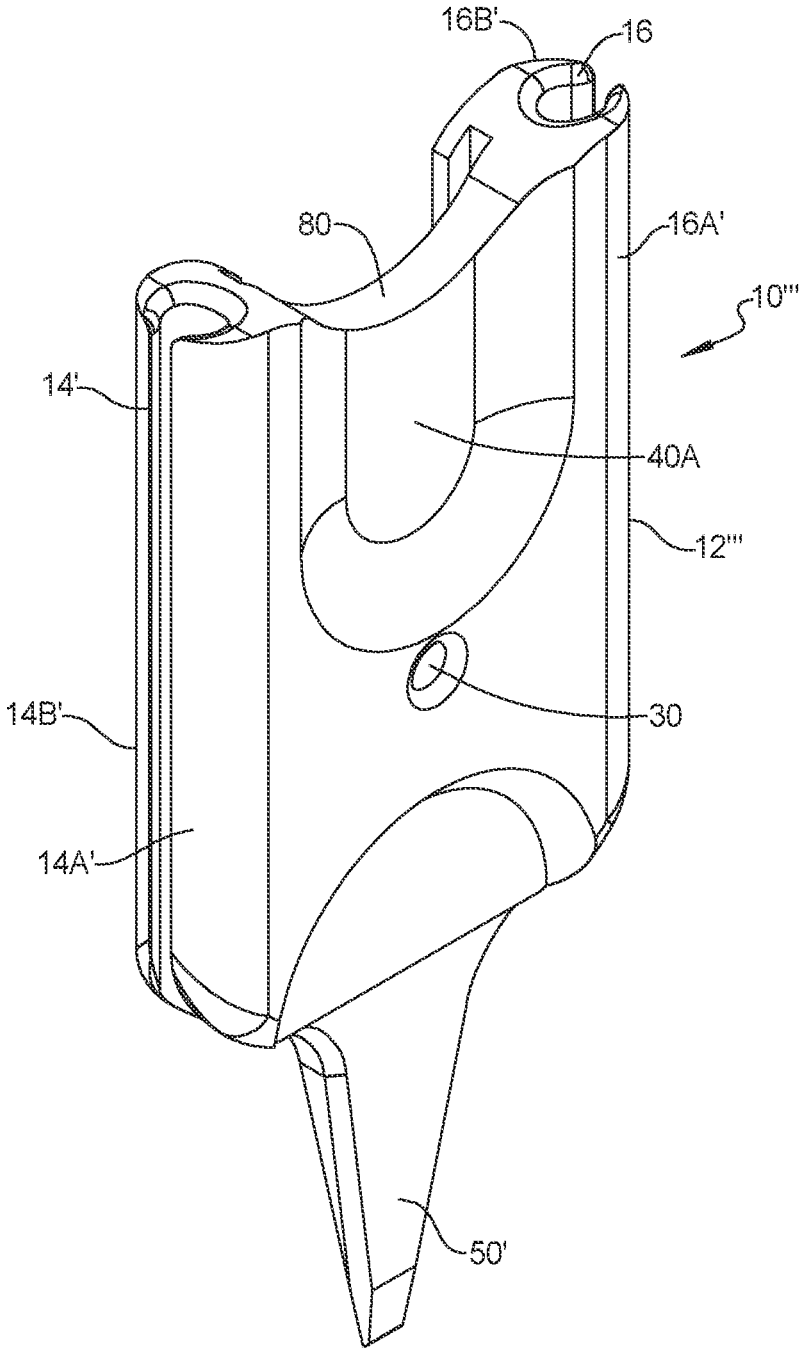
FIG. 4 is a rear respective view of a fourth example of a divot repair tool having a clip slot and a single tool extension.

Referring now to FIG. 4, a fourth embodiment of a divot repair tool 10''' is set forth. In this example, the body 12''' is similar to that illustrated above with respect to FIGS. 3A-3C. However, only one tool extension 50' is provided rather than two tool extensions 50A, 50B illustrated in FIGS. 3A-3C.

Figure 5:
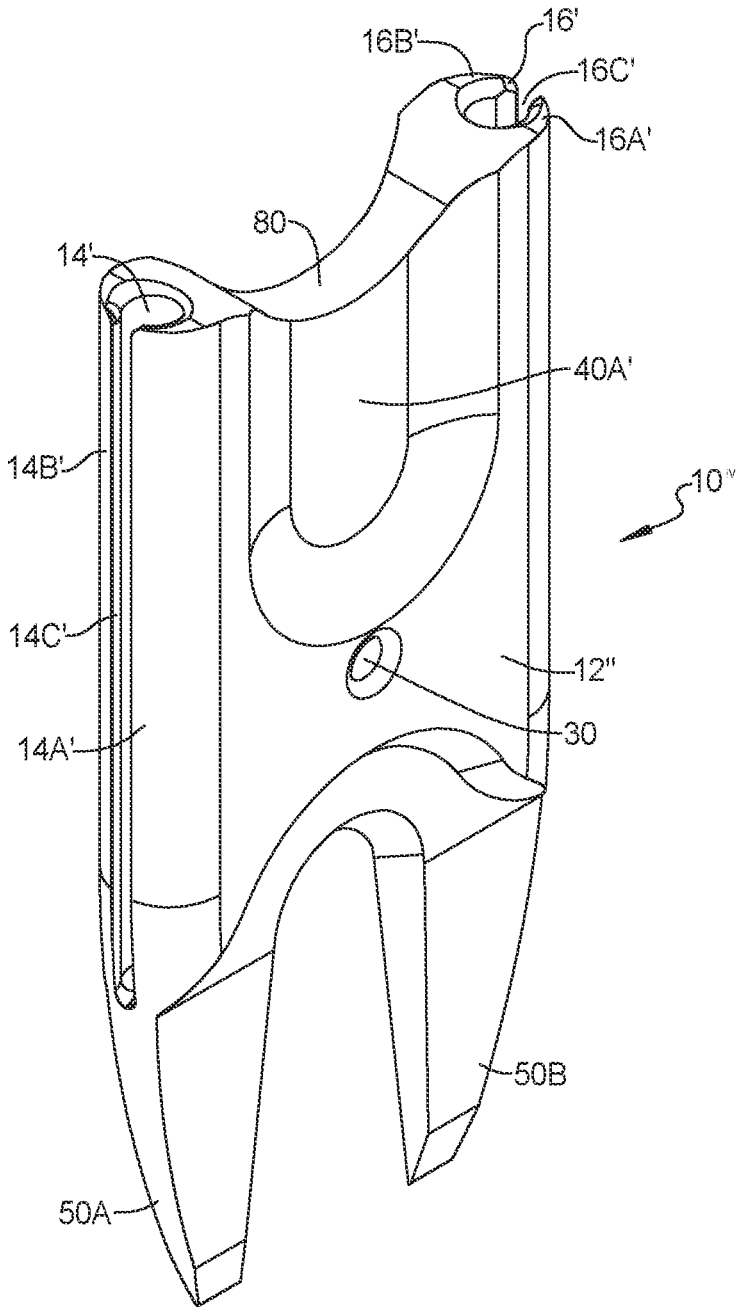
FIG. 5 is a fifth example of a divot repair tool that does not include a clip.

Referring now to FIG. 5, similar examples of a divot repair tool $\mathbf{10}^{iv}$ is set forth. In this example, the clip has been removed and therefore the backside of the divot repair tool is the same as the front side, which has the recess 40A'.

Figure 6A:
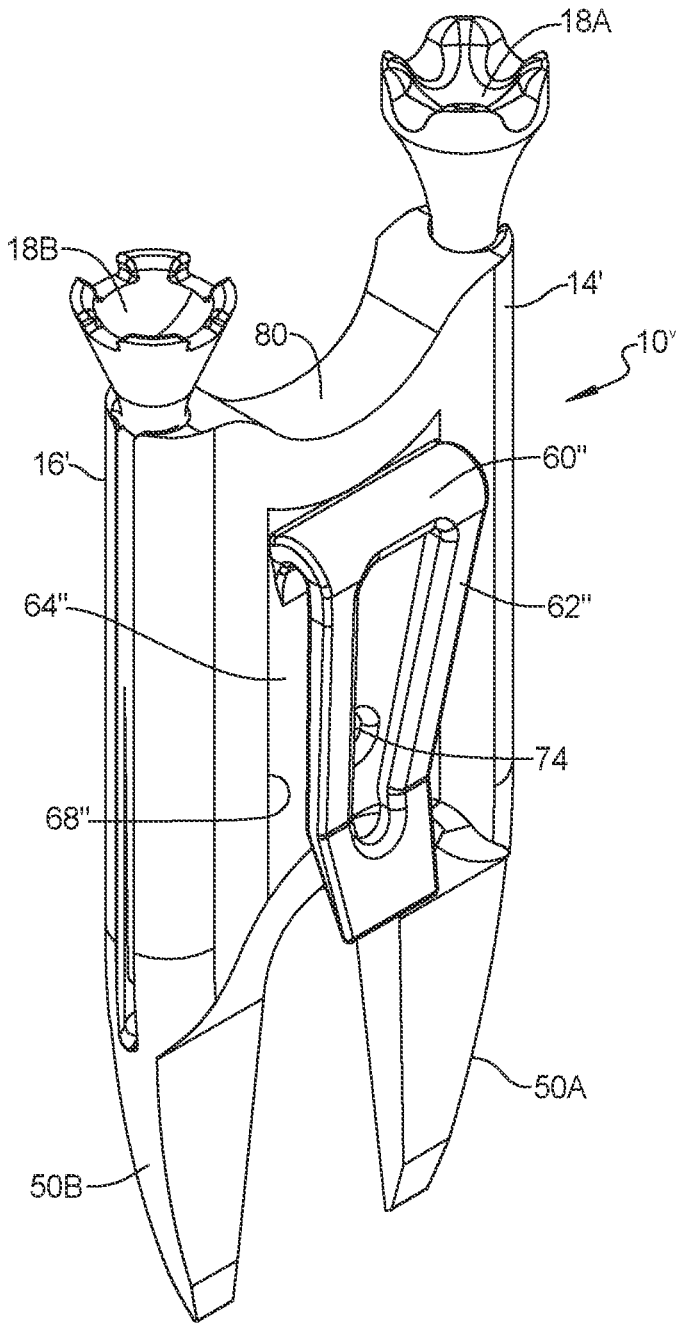
FIG. 6A is a rear perspective view of a sixth example of a divot repair tool having a clip with a clip slot that is accessed from the bottom of the divot repair tool.

Referring now to FIG. 6A, the backside of a divot repair tool $\mathbf{10}^{v}$ is set forth. In this sixth example of the divot repair tool $\mathbf{10}^{v}$, a clip 60" with a clip arm 62" and a clip key 64" is set forth. In this example, the clip slot 68" is illustrated as receiving the clip 60" in the upwardly longitudinally direction. That is, the clip key 64" is inserted into the clip slot 68 from the bottom end of the body 12 adjacent to the tool extensions 50A, 50B.

Figure 6B:
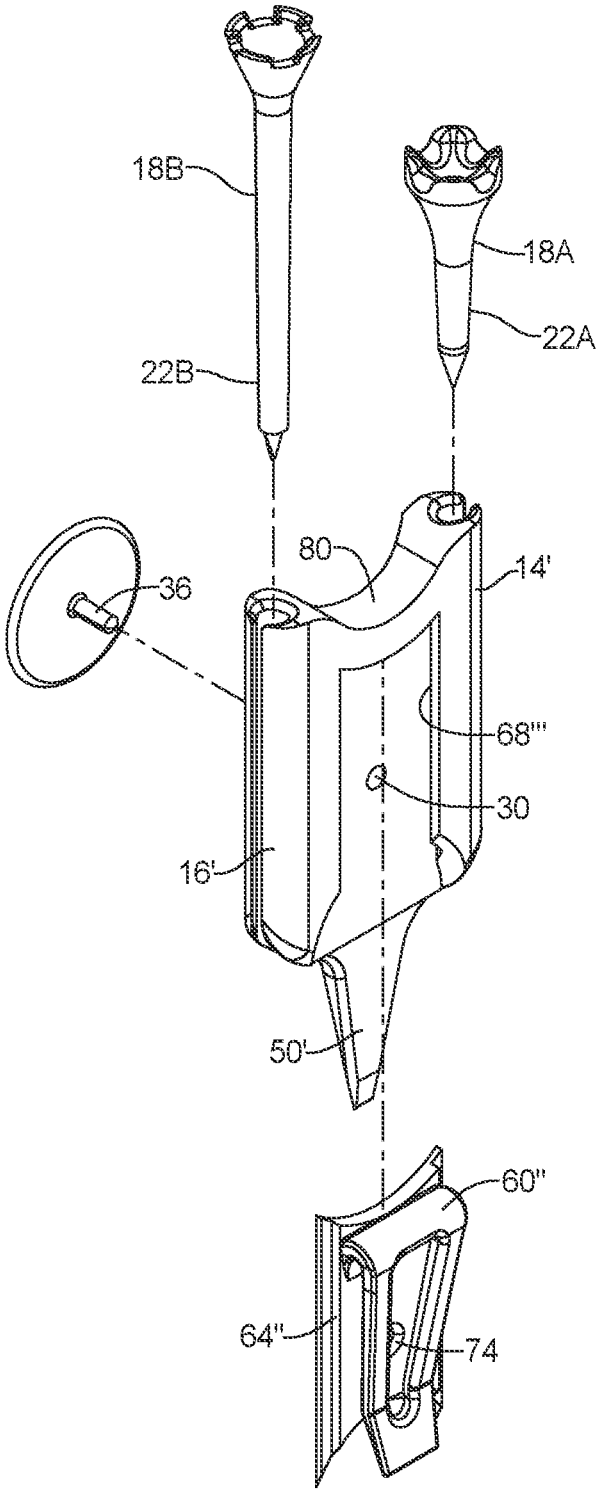
FIG. 6B is an exploded perspective view of the divot repair tool of FIG. 6A.

Referring now to FIG. 6B, the divot repair tool $\mathbf{10}^{v}$ is illustrated in a disassembled state. That is, the clip 60''' is shown with the clip key 64" removed from the slots 68'''. It should be noted that the clip key 64 may have receiving hole 74 disposed there through that aligns with the ball marker receiver 30 to allow the retaining post 36 to extend there through if needed.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A golf divot repair tool comprising:

an elongated body having a front side, a rear side, a right side, a left side, a bottom side and a top side, said elongated body comprising a longitudinal axis, said elongated body comprising a first raised portion disposed along the bottom side;

a first tee receiver disposed along the right side and forming a second raised portion;

a second tee receiver disposed along the left side and forming a third raised portion, said first raised portion, the second raised portion and the third raised portion defining a recess on the front side of the elongated body;

a ball marker receiver disposed in the body, the ball marker receiver is a hole disposed in and is surrounded by the first raised portion on the front side, said hole extending toward the rear side;

a tool extension extending from the bottom side of the body; and the top side of the elongated body comprises a rest curved inward toward the tool extension.

2. The golf divot repair tool as recited in claim 1 wherein the first tee receiver and the second tee receiver are parallel to the longitudinal axis.

3. The golf divot repair tool as recited in claim 1 wherein the first tee receiver and the second tee receiver are angled relative to the longitudinal axis.

4. The golf divot repair tool as recited in claim 3 wherein the first tee receiver has a first end and a second end, said second end closer to the longitudinal axis than the first end.

5. The golf divot repair tool as recited in claim 1 further comprising a ball marker received within said hole, and wherein the first raised portion extends laterally relative to the body, said hole receiving the ball marker so that the ball marker extends below the first raised portion toward the tool extension.

6. The golf divot repair tool as recited in claim 1 wherein the first raised portion extends laterally across the body from the right side to the left side on a front side of the elongated body.

7. The golf divot repair tool as recited in claim 1 wherein a fourth raised portion extends laterally across the body from the right side to the left side on the rear side of the elongated body opposite the first raised portion.

8. The golf divot repair tool as recited in claim 1 wherein the tool extension comprises a wedge-shape.

9. The golf divot repair tool as recited in claim 1 wherein the first tee receiver comprises a first portion adjacent the front side and a second portion adjacent the rear side.

10. The golf divot repair tool as recited in claim 1 further comprising a clip extending from a rear side.

11. The golf divot repair tool as recited in claim 10 wherein the clip is removably coupled to the rear side.

12. The golf divot repair tool as recited in claim 10 wherein the clip is coupled within a U-channel.

13. The golf divot repair tool as recited in claim 1 further comprising a ball marker received within the ball marker receiver.

14. A golf divot repair tool comprising:

an elongated body having a front side, a rear side, a right side, a left side, a bottom side and a top side, said elongated body comprising a longitudinal axis, said elongated body comprising a recess disposed between the right side and the left side and a first raised portion adjacent to the bottom side;

a first tee receiver disposed along the right side and forming a second raised portion;

a second tee receiver disposed along the left side and forming a third raised portion;

said recess disposed between the first raised portion, the second raised portion, the third raised portion and the top side;

a ball marker receiver disposed in the first raised portion; and a tool extension extending from a bottom side of the body adjacent the first raised portion.

15. The golf divot repair tool of claim 14 wherein the top side of the elongated body comprises a rest curved inward toward the tool extension.

16. The golf divot repair tool as recited in claim 14 wherein the first raised portion extends laterally across the body from the right side to the left side on a front side of the elongated body.

17. The golf divot repair tool as recited in claim 14 wherein the tool extension comprises a wedge comprising two tapered surfaces.

18. The golf divot repair tool as recited in claim 1 wherein the tool extension comprises a wedge comprising two tapered surfaces.

* * * * *